US007400081B2

(12) United States Patent
Ishiguro

(10) Patent No.: US 7,400,081 B2
(45) Date of Patent: Jul. 15, 2008

(54) COMPACT SPARK PLUG WITH HIGH GAS TIGHTNESS

(75) Inventor: Hiroyuki Ishiguro, Kariya (JP)

(73) Assignee: Denso Corporation (JP)

( * ) Notice: Subject to any disclaimer, the term of this patent is extended or adjusted under 35 U.S.C. 154(b) by 560 days.

(21) Appl. No.: 11/188,772

(22) Filed: Jul. 26, 2005

(65) Prior Publication Data

US 2006/0022566 A1 Feb. 2, 2006

(30) Foreign Application Priority Data

Jul. 27, 2004 (JP) ..... 2004-218793
May 24, 2005 (JP) ..... 2005-150996

(51) Int. Cl.
*H01T 13/20* (2006.01)

(52) U.S. Cl. ..... 313/143; 313/144; 313/141

(58) Field of Classification Search ..... 313/141–145; 123/169 EL

See application file for complete search history.

(56) References Cited

U.S. PATENT DOCUMENTS 6,707,237 B2 3/2004 Teramura et al. ..... 313/143
2005/0110381 A1* 5/2005 Kanao ..... 313/141

FOREIGN PATENT DOCUMENTS

| | | | |
|---|---|---|---|
| EP | 1022829 | A1 * | 7/2000 |
| EP | 1209784 | A1 * | 5/2002 |
| EP | 1324446 | A2 * | 7/2003 |
| EP | 1341281 | A2 * | 9/2003 |
| JP | 2001-307858 | | 11/2001 |

* cited by examiner

*Primary Examiner*—Mariceli Santiago
(74) *Attorney, Agent, or Firm*—Nixon & Vanderhye PC

(57) ABSTRACT

A spark plug has a compact structure where a threaded portion of a metal shell has a size of M10 or M12 and the width between any two opposite side surfaces of a polygonal prism-shaped portion of the metal shell is no greater than 14 mm. In the spark plug, a thickness A of the polygonal prism-shaped portion of the metal shell, a thickness B of a crimped portion of the metal shell, and a thickness C of a buckled portion of the metal shell are subject to a dimensional relationship of A>B>C. Through specifying such a relationship, the crimped portion of the metal shell exerts a large constricting force on sealing members provided in a gap between the inner surface of the polygonal prism-shaped portion of the metal shell and the outer surface of an insulator, thereby securing high gas tightness of the spark plug.

8 Claims, 9 Drawing Sheets

COMPACT SPARK PLUG WITH HIGH GAS TIGHTNESS

CROSS-REFERENCE TO RELATED APPLICATION

This application claims priority from Japanese Patent Applications No. 2004-218793, filed on Jul. 27, 2004, and No. 2005-150996, filed on May 24, 2005, the contents of which are hereby incorporated by reference into this application.

BACKGROUND OF THE INVENTION

1. Technical Field of the Invention

The present invention relates generally to spark plugs for internal combustion engines.

More particularly, the invention relates to a compact spark plug which includes a metal shell having an M10 or M12 threaded portion and is highly gas tight.

2. Description of the Related Art

Conventional spark plugs for use in internal combustion engines generally include a tubular metal shell, an insulator, a center electrode, and a ground electrode.

The tubular metal shell has a length; it also has a first end and a second end that are opposite to each other in the lengthwise direction of the metal shell. The metal shell includes a threaded portion on the outer periphery thereof for fitting the spark plug into a combustion chamber of an engine.

The insulator has a center bore formed therethrough; it is fixed in the metal shell such that an end thereof protrudes from the first end of the metal shell.

The center electrode is so secured in the center bore of the insulator that an end thereof protrudes from the end of the insulator.

The ground electrode has a based end joined to the first end of the metal shell and a tip portion that faces the end of the center electrode in the lengthwise direction of the metal shell through a spark gap formed therebetween.

In such a spark plug as described above, in order to form a hermetic seal between the metal shell and the insular at the second end of the metal shell, sealing members are provided in a gap formed between the inner surface of the metal shell and the outer surface of the insulator in proximity of the second end of the metal shell. The sealing members include two metal rings and powdered talc, which are embedded in the gap such that the talc is interposed between the two metal rings in the lengthwise direction of the metal shell.

Further, in order to form the hermetic seal, the metal shell is crimped at the second end thereof, thus forming a crimped portion of the metal shell. The crimped portion of the metal shell exerts a constricting force on the sealing members, whereby the hermetic seal between the insulator and the metal shell is achieved and the insulator is fixed to the metal shell.

In recent years, the demand for higher power output of internal combustion engines has required increasing the sizes of intake and exhaust valves for the engine and securing a water jacket for cooling of the engine. This results in a decreased space available for installing a spark plug in the engine, thus requiring the spark plug to have a compact (more specifically, slenderized) structure.

Specifically, the threaded portion of the metal shell in a spark plug had a size of M14 as specified in JIS (Japanese Industrial Standards) in the past. For example, Japanese Patent First publication No. 2001-307858, an English equivalent of which is U.S. Pat. No. 6,707,237, discloses a spark plug that includes such a M14 threaded portion of the metal shell. However, the threaded portion of the metal shell is now required to have a size of M10 or M12 as specified in JIS.

Further, it is also required to reduce the size of a polygonal prism-shaped portion of the metal shell, to which torque is applied by a wrench when the spark plug is installed in the engine. More specifically, to make the spark plug compact, it is required to reduce the width between any two opposite side surfaces of the polygonal prism-shaped portion of the metal shell.

However, in the meantime, such reductions in the size of the threaded portion of the metal shell and the width of the polygonal prism-shaped portion of the same may cause a problem in which the metal shell cannot be rigidly crimped at the second end thereof.

This is because when the spark plug is made compact, the radial thickness of the metal shell is accordingly reduced. Consequently, the wall thickness of the crimped portion of the metal shell is also reduced, thus resulting in a decrease in the rigidity of the crimped portion of the metal shell.

As a result, the crimped portion of the metal shell cannot exert a large constricting force on the sealing members in the gap between the outer surface of the insulator and the inner surface of the metal shell, thus making it impossible to secure a highly gas tight spark plug.

To solve such a problem, one may consider, instead of reducing the radial thickness of the metal shell, reducing the radial thickness of the insulator for making the spark plug compact.

However, in the meantime, such reduction in the radial thickness of the insulator, which electrically isolates the center electrode from the metal shell, may cause a flashover of the insulator.

Accordingly, it is impossible to reduce the radial thickness of the insulator for the purpose of making the spark plug compact.

SUMMARY OF THE INVENTION

The present invention has been made in view of the above-mentioned problem.

It is, therefore, a primary object of the present invention to provide a compact spark plug with high gas tightness, in which a threaded portion of a metal shell has a size of M10 or M12, a width between any two opposite side surfaces of a polygonal prism-shaped portion of the metal shell is no greater than 14 mm, and a crimped portion of the metal shell has sufficiently high rigidity.

The inventor of the present invention has considered that it is possible to secure high gas tightness of such a compact spark plug through specifying dimensional parameters pertaining to the metal shell of the spark plug.

The present invention is derived from the results of experimental investigation based on the above consideration.

According to the first aspect of the present invention, a spark plug is provided which includes a tubular metal shell, a hollow insulator, a center electrode, a ground electrode, and sealing members.

The tubular metal shell has an axis and a first end and a second end that are opposite to each other in an axial direction of the metal shell. The metal shell includes a threaded portion, a polygonal prism-shaped portion, and a buckled portion. The threaded portion is formed on an outer periphery of the metal shell close to the first end of the metal shell and has a size of one of M10 and M12. The polygonal prism-shaped portion is formed close to the second end of the metal shell and has a width, which is a distance between any two opposite side surfaces of the polygonal prism-shaped portion, of no greater than 14 mm. The buckled portion is positioned between the threaded portion and the polygonal prism-shaped portion in the axial direction of the metal shell. The metal shell also includes a crimped portion formed at the second end of the metal shell and a frustoconical shoulder that is provided between the polygonal prism-shaped portion and the crimped portion and tapers toward the crimped portion.

The hollow insulator is fixed in the metal shell and has an end that protrudes from the first end of the metal shell.

The center electrode is secured in the insulator and has an end that protrudes from the end of the insulator.

The ground electrode has a based end joined to the first end of the metal shell and a tip portion that faces the end of the center electrode in the axial direction of the metal shell through a spark gap.

The sealing members are provided in a gap between an inner surface of the polygonal prism-shaped portion of the metal shell and an outer surface of the insulator. The sealing members are subject to a constricting force exerted by the crimped portion of the metal shell to form a hermetic seal between the metal shell and the insulator.

Further, in the above spark plug, the following dimensional relationship is specified:

$A>B>C$, where

A is a minimum radial thickness of the polygonal prism-shaped portion of the metal shell on a first reference plane that is defined to extent perpendicular to the axis of the metal shell through a middle position of the polygonal prism-shaped portion in the axial direction of the metal shell, B is a distance between an inner surface of the crimped portion of the metal shell and a reference point in a radial direction of the metal shell, the reference point being defined, on a second reference plane that is defined to extend to include the axis of the metal shell thereon, as an intersection between a first reference line and a second reference line, the first reference line being defined to extend tangent to an outer surface of the crimped portion of the metal shell through a first end of an arc that continues to the outer surface of the crimped portion at the first end and to an outer surface of the frustoconical shoulder of the metal shell at a second end thereof, the second reference line being defined to extend, through the second end of the arc, to have a section thereof on the outer surface of the frustoconical shoulder, and C is a radial thickness of the buckled portion of the metal shell on a third reference plane that is defined to extent perpendicular to the axis of the metal shell through a middle position of the buckled portion in the axial direction of the metal shell.

Through specifying the above relationship between A, B, and C, sufficiently high rigidity of the crimped portion of the metal shell is secured, and during formation of the crimped portion, the buckled portion of the metal shell is easily formed while the polygonal prism-shaped portion of the same is prevented from deformation.

As a result, the sealing members in the gap are subject to a large constricting force exerted by the crimped portion of the metal shell, so that high gas tightness of the spark plug is secured.

Further, in the spark plug, the following dimensional relationship is specified:

$B \geqq 1.1\ C$.

Through specifying the above relationship between B and C, the sealing members in the gap are further reliably subject to a large constricting force exerted by the crimped portion of the metal shell, so that high gas tightness of the spark plug is further reliably secured.

Furthermore, in the spark plug, C is specified to be in a range of 0.5 to 1.0 mm.

Through specifying the range of C as above, the buckled portion of the metal shell is more easily formed during formation of the crimped portion of the metal shell and has sufficiently high rigidity.

According to the second aspect of the present invention, in the spark plug, the metal shell is formed by crimping an uncrimped metal shell that includes:

a second end portion that is formed at a second end of the uncrimped metal shell and to be crimped to form the crimped portion of the metal shell;

a polygonal prism-shaped portion that is to form the polygonal prism-shaped portion of the metal shell; and a first frustoconical shoulder that is provided between the second end portion and the polygonal prism-shaped portion of the uncrimped metal shell and tapers toward the second end portion, and wherein a length D of the second end portion of the uncrimped metal shell is in a range of 0.7 to 4.0 mm, which is a distance between the second end of the uncrimped metal shell and a first reference point in an axial direction of the uncrimped metal shell, the first reference point being defined, on a reference plane that is defined to extend to include an axis of the uncrimped metal shell thereon, as an intersection between a first reference line and a second reference line, the first reference line being defined to extend tangent to an outer surface of the second end portion of the uncrimped metal shell through a first end of an arc that continues to the outer surface of the second end portion at the first end and to an outer surface of the first frustoconical shoulder of the uncrimped metal shell at a second end thereof, the second reference line being defined to extend, through the second end of the arc, to have a section thereof on the outer surface of the first frustoconical shoulder of the uncrimped metal shell.

Through specifying the range of D as above, the crimped portion of the metal shell is prevented from colliding with the insulator and securely constricts the sealing members in the gap.

It is preferable that the length D of the second end portion of the uncrimped metal shell is in a range of 1.5 to 3.5 mm.

Moreover, the uncrimped metal shell further includes:

a threaded portion that is to form the threaded portion of the metal shell;

an intermediate portion that is positioned between the polygonal prism-shaped portion and the threaded portion of the uncrimped metal shell and to be buckled to form the buckled portion of the metal shell when the second end portion is crimped to form the crimped portion of the metal shell;

a second frustoconical shoulder that is provided between the polygonal prism-shaped portion and the intermediate portion and tapers toward the intermediate portion; and a third frustoconical shoulder that is provided between the intermediate portion and the threaded portion and tapers toward the intermediate portion, and wherein a length E of the intermediate portion of the uncrimped metal shell is in a range of 1.5 to 4.0 mm, which is a distance between a second reference point and a third reference point, the second reference point being defined, in the reference plane, as an intersection between a third reference line and a fourth reference line, the third reference line being defined to extend to have a section thereof on an outer surface of the second frustoconical shoulder, the fourth reference line being defined to extend to have a section thereof on an outer surface of the intermediate portion, the third reference point being defined, in the reference plane, as an intersection between the fourth reference line and a fifth reference line, the fifth reference line being defined to extend to have a section thereof on an outer surface of the third frustoconical shoulder.

Through specifying the range of E as above, the buckled portion of the metal shell is easily formed during formation of the crimped portion of the metal shell and prevented from having an aberrant form and colliding with the insulator.

According to the third aspect of the present invention, in the spark plug, the sealing members include two metal rings and a filler, which are arranged in the gap between the inner surface of the polygonal prism-shaped portion of the metal shell and the outer surface of the insulator such that the filler is interposed between the two metal rings in the axial direction of the metal shell.

Further, in the spark plug, a length L of the gap is specified to be no less than 3.0 mm, which is a minimum distance between outer surfaces of the two metal rings in the axial direction of the metal shell.

Furthermore, in the spark plug, a width T of the gap is specified to be no less than 1.0 mm, which is a distance between the inner surface of the polygonal prism-shaped portion of the metal shell and the outer surface of the insulator in the radial direction of the metal shell on the first reference plane.

Specifying the ranges of L and T as above, a large quantity of the filler is embedded in the gap, so that the leakage from the inside of the metal shell through the crimped portion of the same is suppressed, thus securing high gas tightness of the spark plug.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
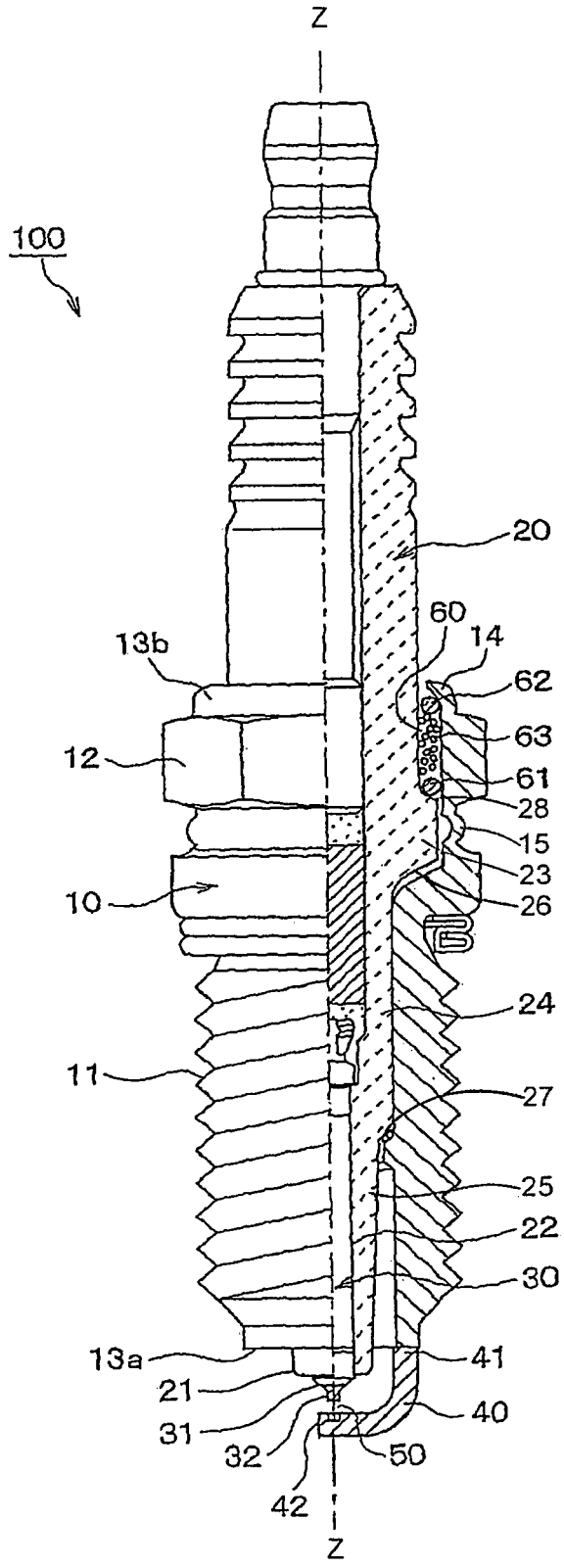
FIG. 1 is a partially cross-sectional side view showing the overall structure of a spark plug according to the first embodiment of the invention.

The preferred embodiments of the present invention will be described hereinafter with reference to FIGS. 1-9.

It should be noted that, for the sake of clarity and understanding, identical components having identical functions in different embodiments of the invention have been marked, where possible, with the same reference numerals in each of the figures.

First Embodiment

FIG. 1 shows the overall structure of a spark plug 100 according to the first embodiment of the invention. The spark plug 100 is designed for use in internal combustion engines of automotive vehicles.

As shown in FIG. 1, the spark plug 100 includes a metal shell 10, an insulator 20, a center electrode 30, and a ground electrode 40.

The tubular metal shell 10 is made of a conductive metal material, for example low-carbon steel. The metal shell 10 has an axis Z; it also has a first end 13*a* and a second end 13*b* that are opposite to each other in the axial direction of the metal shell 10.

The metal shell 10 includes, on an outer periphery thereof close to the first end 13*a*, a male threaded portion 11 that has a size of M12 as specified in JIS.

The metal shell 10 also includes a polygonal prism-shaped portion 12 formed close to the second end 13*b*, a buckled portion 15 positioned between the threaded portion 11 and the polygonal prism-shaped portion 12, and a crimped portion 14 formed at the second end 13*b*.

In this embodiment, the polygonal prism-shaped portion 12 has a shape of hexagon in any cross section perpendicular to the axis Z of the metal shell 10. Moreover, the width between any two opposite side surfaces of the polygonal prism-shaped portion 12 is no greater than 14 mm.

The installation of the spark plug 100 in an internal combustion engine is achieved by fitting it into a combustion chamber (not shown) of the engine. More specifically, in the installation, the polygonal prism-shaped portion 12 is torqued so as to establish an engagement between the male threaded portion 11 of the metal shell 10 and a female threaded bore provided in the cylinder head (not shown) of the combustion chamber.

The insulator 20 is made of alumina ceramic ($Al_2O_3$); it is fixed and partially contained in the metal shell 10 such that an end 21 of the insulator 20 protrudes from the first end 13*a* of the metal shell 10. The insulator 20 has a center bore 22 that is formed through the insulator 20 in the lengthwise direction of the insulator 20.

The cylindrical center electrode 30 is secured in the center bore 22 of the insulator 20, so that it is electrically isolated from the metal shell 10. The center electrode 30 is partially included in the metal shell 10 together with the insulator 20 such that an end 31 of the center electrode 30 protrudes form the end 21 of the insulator 20.

The center electrode 30 is made of a highly heat conductive metal material such as Cu as the core material and a highly heat-resistant, corrosion-resistant metal material such as a Ni (Nickel)-based alloy as the clad material.

The center electrode 30 includes a noble metal chip 32 that is joined to the end 31 of the center electrode 30 by laser welding. The noble metal chip 32 has the shape, for example, of a circular cylinder. The noble metal chip 32 is made, preferably, of an Ir (Iridium)-based alloy including Ir in an amount of greater than 50 weight percent.

The ground electrode 40, which is made of a Ni-based alloy consisting mainly of Ni, is column-shaped, for example an approximately L-shaped prism in this embodiment.

The ground electrode 40 has a base end 41 that is joined, for example by resistance welding, to the first end 13*a* of the metal shell 10.

The ground electrode 40 has also a tip portion 42 including a side surface that faces the noble metal chip 32 of the center electrode 30 in the axial direction of the metal shell 10 through a spark gap 50.

The spark plug 100 is configured to discharge sparks in the spark gap 50 between the center electrode 30 and the ground electrode 40, thereby igniting the air/fuel mixture within a combustion chamber of an engine.

Having described the overall structure of the spark plug 100, the formation of a hermetic seal in the spark plug 100 will be described below.

The insulator 20 includes, as shown in FIG. 1, a waist portion 23 that is positioned within the metal shell 10 and has the largest outer diameter in the insulator 20. The insulator 20 also includes an intermediate portion 24 that is positioned, within the metal shell 10, closer to the end 21 of the insulator 20 than the waist portion 23 and smaller in outer diameter than the waist portion 23. Between the waist portion 23 and the intermediate portion 24, there is provided a shoulder 26 on the outer surface of the insulator 20. Further, the insulator 20 also includes a diameter-reducing portion 25 that tapers toward the end 21 of the insulator 20. Between the intermediate portion 24 and the diameter-reducing portion 25, there is provided another shoulder 27 on the outer surface of the insulator 20.

To accommodate such an insulator 20 therein, the metal shell 10 has an inner surface that is fitted to the outer surface of the insulator 20. For example, there are provided two shoulders on the inner surface of the metal shell 10, which are formed corresponding to the shoulders 26 and 27 on the outer surface of the insulator 20. The insulator 20 is inserted into the inside of the metal shell 10 from the second end 13*b*.

Figure 2A:
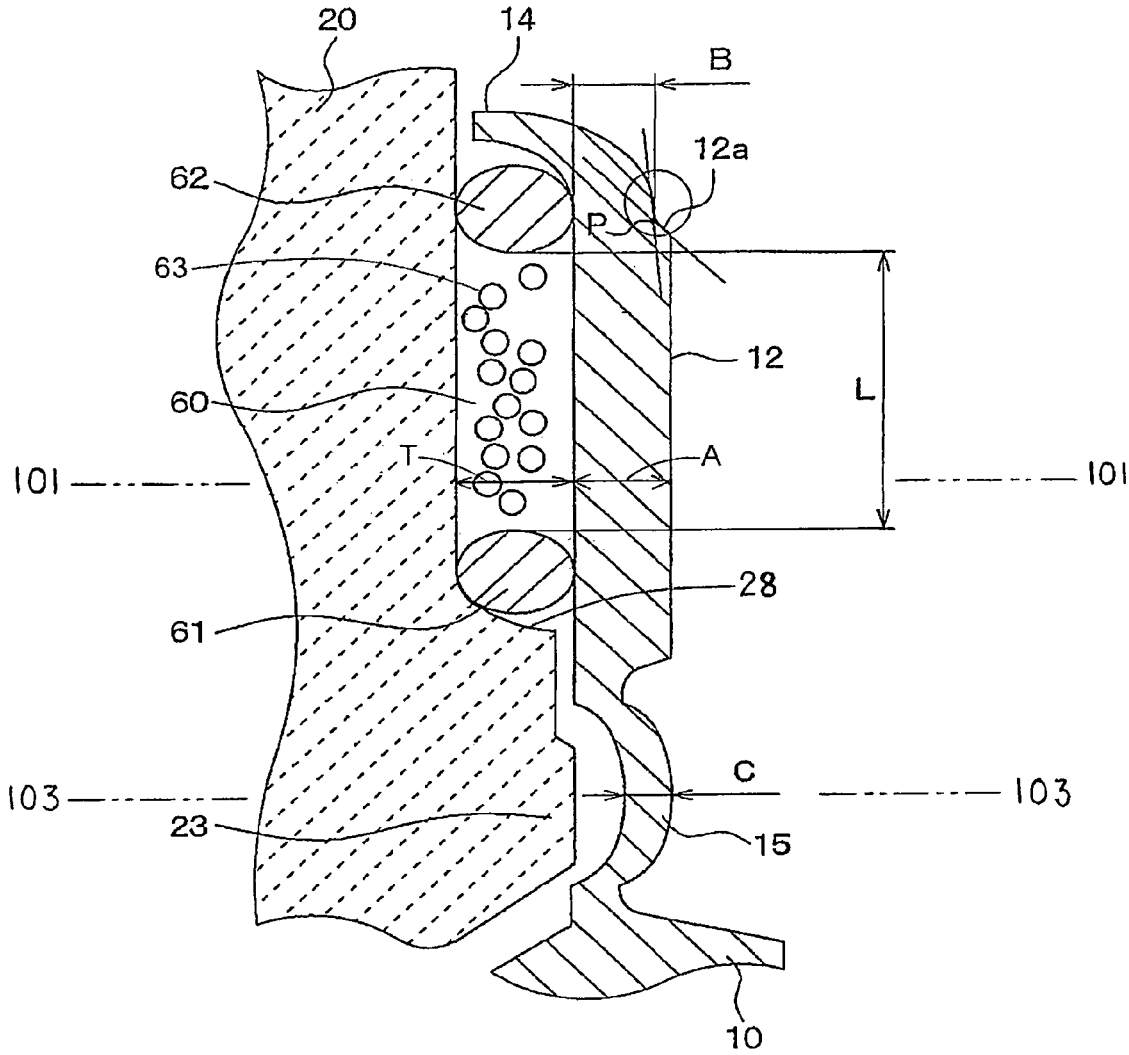
FIG. 2A is an enlarged partially cross-sectional side view illustrating a formation of hermetic seal in the spark plug of FIG. 1.

Referring now to FIG. 2A, the outer diameter of the insulator 20 is reduced from the waist portion 23 through a shoulder 28, so that a gap 60 is formed between the outer surface of the insulator 20 and the inner surface of the polygonal prism-shaped portion 12 of the metal shell 10.

In the gap 60, there are embedded sealing members 61-63. Specifically, the sealing members 61-63 include a first metal ring 61, a second metal ring 62, and talc 63. The first and second metal rings 61 and 62 are made, for example, of Iron (Fe). The talc 63 is in powdered form and employed as a filler to fill the space between the outer surface of the insulator 20 and the inner surface of the polygonal prism-shaped portion 12 of the metal shell 10. The sealing members 61-63 are arranged in the gap 60 such that the powered talc 63 is interposed between the first and second metal rings 61 and 62 in the axial direction of the metal shell 10.

In order to form a hermetic seal between the metal shell 10 and the insulator 20, the metal shell 10 is crimped (or plastically deformed) at the second end 13*b* thereof, thus forming the crimped portion 14 of the metal shell 10. The crimped portion 14 exerts a constricting force on the sealing members 61-63 in the gap 60, whereby the insulator 20 is fixed to the metal shell 10. Additionally, a frustoconical shoulder 12*a* is provided between the crimped portion 14 and the polygonal prism-shaped portion 12, which tapers from the polygonal prism-shaped portion 12 toward the crimped portion 14.

Moreover, during the formation of the crimped portion 14, an intermediate portion of the metal shell 10 between the polygonal prism-shaped portion 12 and the threaded portion 11 is buckled (or outwardly deformed) to form the buckled portion 15, whereby the sealing members 61-63 are further firmly constricted in the axial direction of the metal shell 10.

As a result, a hermetic seal between the metal shell 10 and the insulator 20 is achieved at the second end 13*b* of the metal shell 10, thereby securing gas tightness of the spark plug 100.

As described previously, in the spark plug 100 according to the present embodiment, both the outer diameter of the threaded portion 11 and the width between any two opposite side surfaces of the polygonal prism-shaped portion 12 are made smaller than those in a spark plug that includes a metal shell having a M14 threaded portion.

Figure 2B:
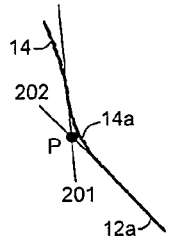
FIG. 2B is a further enlarged view showing the part of FIG. 2A that is indicated with a circle in FIG. 2A.
Figure 2C:
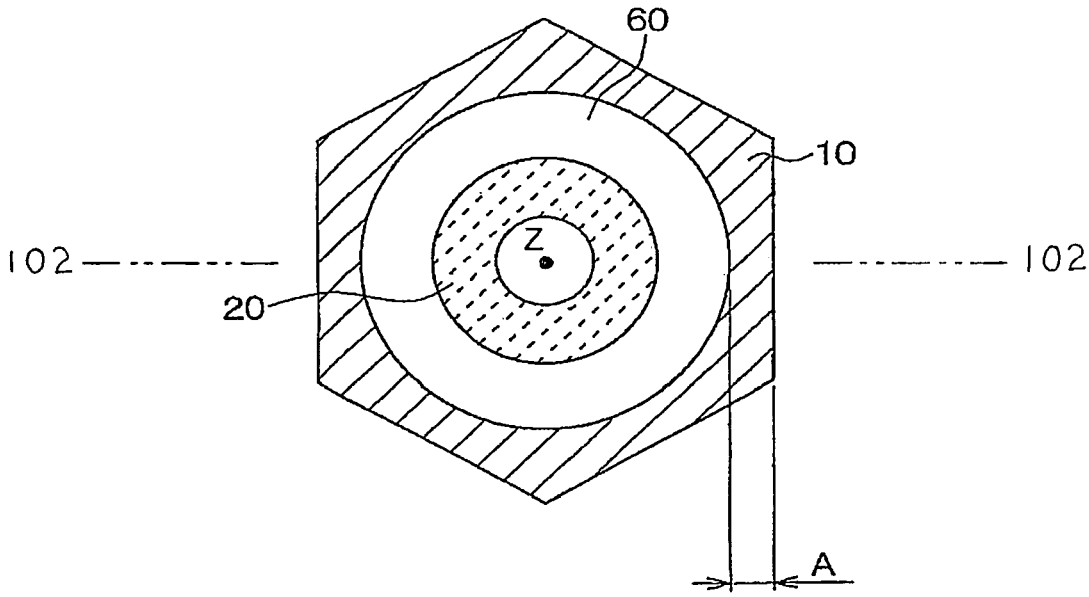
FIG. 2C is a cross sectional view of a polygonal prism-shaped portion of a metal shell in the spark plug of FIG. 1, which is taken perpendicular to the axis of the metal shell through the middle poison of the polygonal prism-shaped portion in the axial direction of the metal shell.

In such a compact spark plug 100, referring to FIGS. 2A-2C, the following dimensional parameters have been considered to be critical to the rigidity of the crimped portion 14 of the metal shell 10 and gas tightness of the spark plug 100.

A is a minimum radial thickness of the polygonal prism-shaped portion 12 of the metal shell 10 on a first reference plane 101. The first reference plane 101 is defined to extent perpendicular to the axis Z of the metal shell 10 through the middle position of the polygonal prism-shaped portion 12 in the axial direction of the metal shell 10. The parameter A is to be referred to as a thickness of the polygonal prism-shaped portion 12 hereinafter.

B is a distance between the inner surface of the crimped portion 14 of the metal shell 10 and a reference point P in the radial direction of the metal shell 10. The reference point P is defined, on a second reference plane 102 that is defined to extend to include the axis Z of the metal shell 10 thereon, as an intersection between a first reference line 201 and a second reference line 202. The first reference line 201 is defined to extend tangent to the outer surface of the crimped portion 14 of the metal shell 10 through a first end of an arc 14*a* that smoothly continues to the outer surface of the crimped portion 14 at the first end and to the outer surface of the frustoconical shoulder 12*a* at a second end thereof. The second reference line 202 is defined to extend, through the second end of the arc 14*a*, to have a section thereof on the outer surface of the frustoconical shoulder 12*a*. The parameter B is to be referred to as a thickness of the crimped portion 14 hereinafter.

C is a radial thickness of the buckled portion 15 of the metal shell 10 on a third reference plane 103. The third reference plane 103 is defined to extent perpendicular to the axis Z of the metal shell 10 through the middle position of the buckled portion 15 in the axial direction of the metal shell 10. The parameter C is to be referred to as a thickness of the buckled portion 15 hereinafter.

T is a distance between the inner surface of the polygonal prism-shaped portion 12 of the metal shell 10 and the outer surface of the insulator 20 in the radial direction of the metal shell 10 on the first reference plane 101. The parameter T is to be referred to as a width of the gap 60 hereinafter.

L is a minimum distance between the outer surfaces of the two metal rings 61 and 62 in the axial direction of the metal shell 10. The parameter L is to be referred to as a length of the gap 60 hereinafter.

In addition to the above-defined parameters, dimensional parameters D and E, which pertain to an uncrimped metal shell 10 from which the metal shell 10 is formed, have also been considered to be critical to the rigidity of the crimped portion 14 of the metal shell 10 and gas tightness of the spark plug 100.

Figure 3A:
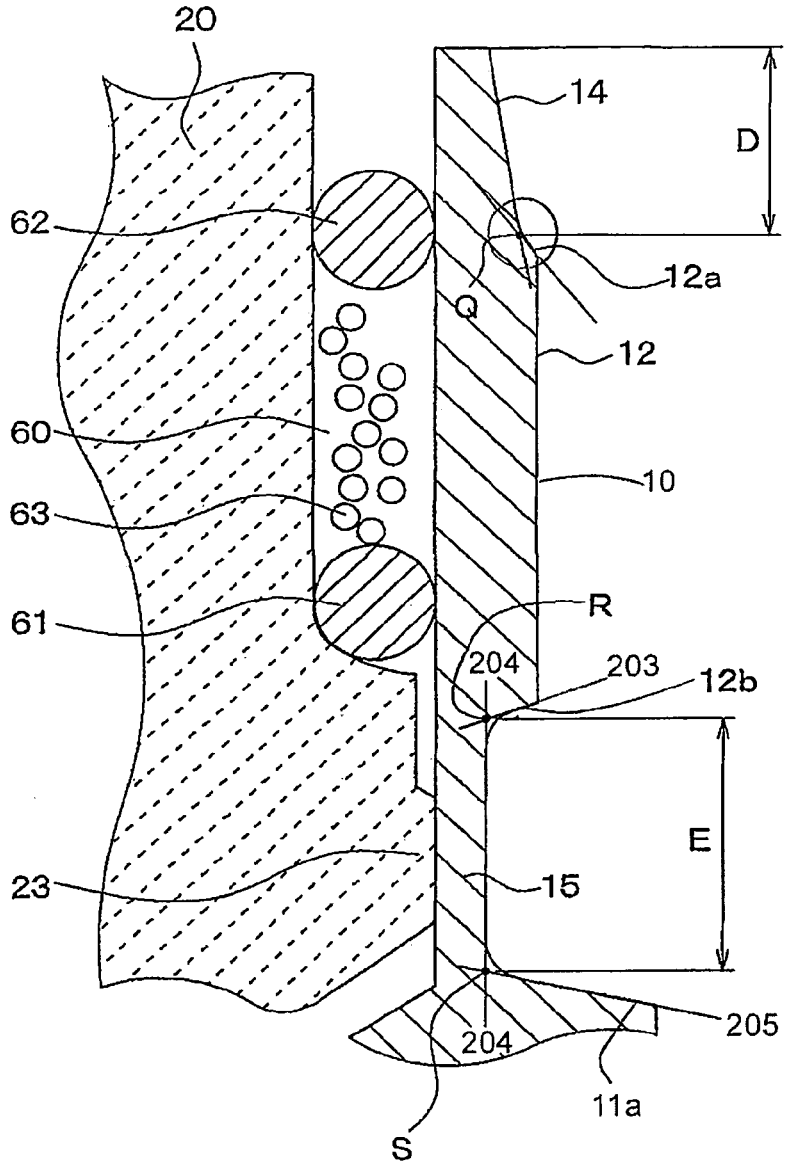
FIG. 3A is an enlarged partially cross-sectional side view showing an uncrimped metal shell from which the metal shell of the spark plug of FIG. 1 is formed.

Specifically, as shown in FIG. 3A, the uncrimped metal shell 10 includes a second end portion 14 and an intermediate portion 15.

The second end portion 14 tapers toward a second end of the uncrimped metal shell 10 and is to be crimped to form the crimped portion 14 of the metal shell 10. In addition, a first frustoconical shoulder 12*a* is provided between the second end portion 14 and a polygonal prism-shaped portion 12 of the uncrimped metal shell 10, which tapers from the polygonal prism-shaped portion 12 toward the second end portion 14.

The intermediate portion 15 is cylindrical in shape and is to be buckled to form the buckled portion 15 of the metal shell 10. In addition, a second frustoconical shoulder 12*b* is provided between the polygonal prism-shaped portion 12 and the intermediate portion 15, which tapers from the polygonal prism-shaped portion 12 toward the intermediate portion 15; a third frustoconical shoulder 11*a* is provided between the intermediate portion 15 and the threaded portion 11, which is tapers from the threaded portion 11 toward the intermediate portion.

Figure 3B:
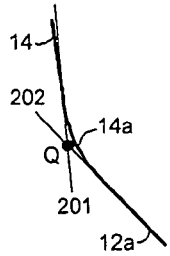
FIG. 3B is a further enlarged view showing the part of FIG. 3A that is indicated with a circle in FIG. 3A.

In such an uncrimped metal shell 10, referring to FIGS. 3A-3C, the parameters D and E are defined as follows.

D is a distance between the second end of the uncrimped metal shell 10 and a first reference point Q in the axial direction of the uncrimped metal shell 10. The first reference point Q is defined, on a reference plane that is defined in the same way as the second reference plane 102 in the metal shell 10, as an intersection between a first reference line 201 and a second reference line 202. The first reference line 201 is defined to extend tangent to the outer surface of the second end portion 14 of the uncrimped metal shell 10 through a first end of an arc 14*a* that smoothly continues to the outer surface of the second end portion 14 at the first end and to the outer surface of the frustoconical shoulder 12*a* of the uncrimped metal shell 10 at a second end thereof. The second reference line 202 is defined to extend, through the second end of the arc 14*a*, to have a section thereof on the outer surface of the frustoconical shoulder 12*a*. The parameter D is to be referred to as a length of the crimped portion 14 of the metal shell 10 hereinafter (though it is actually a length of the second end portion 14 of the uncrimped metal shell 10).

E is a distance between a second reference point R and a third reference point S. The second reference point R is defined, in the reference plane, as an intersection between a third reference line 203 and a fourth reference line 204. The third reference line 203 is defined to extend to have a section thereof on the outer surface of the second frustoconical shoulder 12*b*. The fourth reference line 204 is defined to extend to have a section thereof on the outer surface of the intermediate portion 15. The third reference point S is defined, in the reference plane, as an intersection between the fourth reference line 204 and a fifth reference line 205. The fifth reference line 205 is defined to extend to have a section thereof on the outer surface of the third frustoconical shoulder 11*a*. The parameter E is to be referred to as a length of the buckled portion 15 of the metal shell 10 hereinafter (though it is actually a length of the intermediate portion 15 of the uncrimped metal shell 10).

For the above-defined parameters A, B, C, T, L, D, and E, the effective ranges and dimensional relationships therebetween have been determined as follows.

First, the relationship between the parameters A, B, and C have been specified in light of the following consideration.

To allow the buckled portion 15 of the metal shell 10 to have a large thickness C, the intermediate portion 15 of the uncrimped metal shell 10 must have a correspondingly large wall thickness.

However, when the intermediate portion 15 has a large wall thickness, it accordingly has such a high rigidity that it is difficult to deform the intermediate portion 15 to form the buckled portion 15 of the metal shell 10 when the second end portion 14 of the uncrimped metal shell 10 is crimped to form the crimped portion 14 of the metal shell 10.

Accordingly, it is necessary for C to be small.

Further, to allow the crimped portion 14 of the metal shell 10 to have a small thickness B, the second end portion 14 of the uncrimped metal shell 10 must have a correspondingly small wall thickness.

However, when the second end portion 14 has a small wall thickness, it accordingly has such a low rigidity that it cannot be crimped with high strength to form the crimped portion 14 of the metal shell 10. As a result, the crimped portion 14 of the metal shell 10 cannot exert a large constricting force on the sealing members 61-63, thus making it impossible to secure high gas tightness of the spark plug 100.

Accordingly, it is necessary for B to be large, at least larger than C (i.e., B>C).

Furthermore, if the polygonal prism-shaped portion 12 of the uncrimped metal shell 10 has a wall thickness smaller than those of the second end portion 14 and intermediate portion 15 of the uncrimped metal shell 10, it will be deformed when the second end portion 14 is crimped to form the crimped portion 14 of the metal shell 10. Such deformation of the polygonal prism-shaped portion 12 will result in a decreased gas tightness of the spark plug 100.

Accordingly, it is necessary for A to be larger than both B and C.

Consequently, to prevent deformation of the polygonal prism-shaped portion 12 and to secure sufficiently high rigidity of the crimped portion 14 and gas tightness of the spark plug 100, in this embodiment, the following dimensional relationship has been specified:

$$A>B>C.$$

Secondly, to further reliably secure high gas tightness of the spark plug 100, a more detailed relationship between the thickness B of the crimped portion 14 and the thickness C of the buckled portion 15 has been specified through an experimental investigation.

Sample spark plugs 100 having different B or/and C, in which the outer diameter of the insulator 20 is 9 mm, the width T of the gap 60 is 1.35 mm, the length L of the gap 60 is 4.5 mm, the length D of the crimped portion 14 of the metal shell 10 is 2.3 mm, and the length E of the buckled portion 15 of the meal shell 10 is 3.0 mm, were fabricated for the investigation.

In the investigation, two different tests were conducted using those sample spark plugs 100.

The first test was conducted to measure a constricting force that the crimped portion 14 of the metal shell 10 exerts on the sealing members 61-63 in the axial direction of the metal shell 10. Specifically, in the first test, a strain gage was mounted on the threaded portion 11 of the metal shell 10, and the crimped portion 14 was cut off from the metal shell 10. Then, the sealing members 61-63 were removed from the gap 60, and the value of a strain that was induced in the threaded portion 11 was read from the strain gage. After that, based on the value of the strain, the constricting force was determined through computation.

Figure 4A:
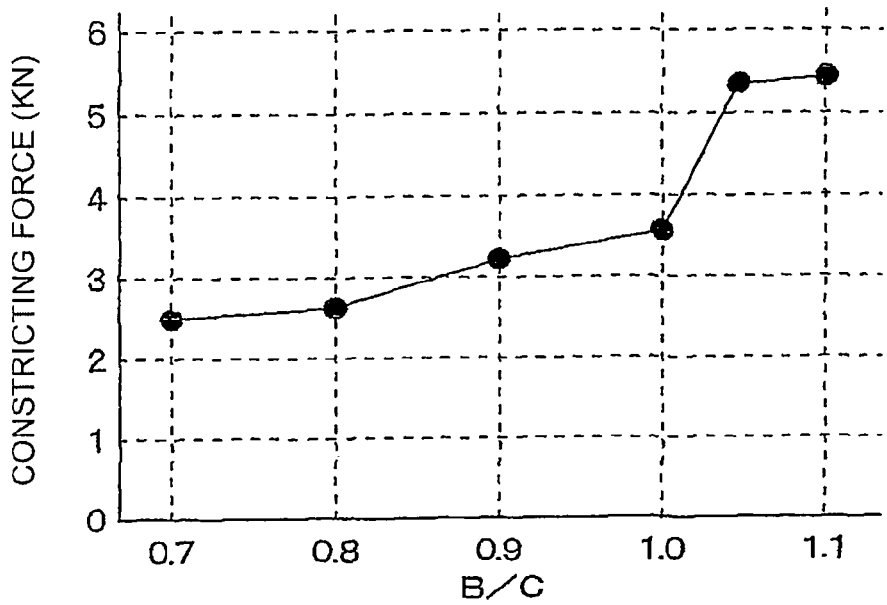
FIG. 4A is a graphical representation showing the relationship between a dimensional parameter B/C and a constricting force in the spark plug of FIG. 1.

FIG. 4A shows the results of the first test, where the horizontal axis indicates a ratio B/C between the thickness B of the crimped portion 14 and the thickness C of the buckled portion 15, while the vertical one indicates the resultant constricting force.

As seen from FIG. 4A, when the ratio B/C was in the range of 0.7 to 1.0, in other words, the thickness B of the crimped portion 14 was no greater than the thickness C of the buckled portion 15, the constricting force was almost constant. However, when the ratio B/C became greater than 1.0, the constricting force increased rapidly. In other words, when the thickness B of the crimped portion 14 was greater than the thickness C of the buckled portion 15, the crimped portion 14 exerted a large constricting force on the sealing members 61-63.

Accordingly, it can be seen from FIG. 4A that specifying the ratio B/C to be no less than 1.1, the crimped portion 14 of the metal shell 10 can exert a sufficiently large constricting force on the sealing members 61-63.

The second test was conducted to measure a leakage rate from the inside of the metal shell 10 through the crimped portion 14 of the same. Specifically, in the second test, each sample spark plug 100 was installed in a pressure chamber in the same manner as in the case of being installed in a combustion chamber of an engine. Then, the leakage rate was measured in a test condition where the air pressure in the pressure chamber was kept at 2 Mpa, and the temperature of the outer side surface of the pressure chamber, on which the sample spark plug 100 was mounted, was kept at 300° C.

Figure 4B:
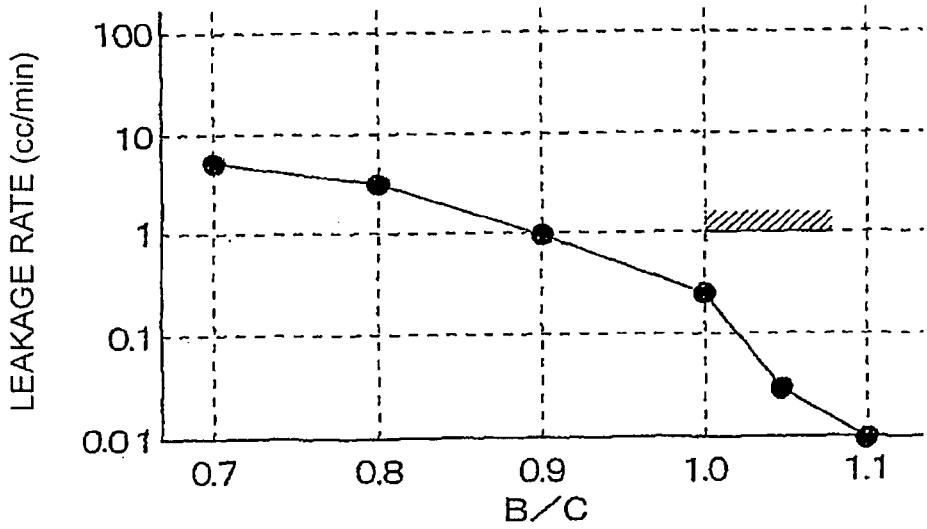
FIG. 4B is a graphical representation showing the relationship between the dimensional parameter B/C and a leakage rate from the inside of the spark plug of FIG. 1.

FIG. 4B shows the results of the second test, where the horizontal axis indicates the ratio B/C between the thickness B of the crimped portion 14 and the thickness C of the buckled portion 15, while the vertical one indicates the resultant leakage rate.

As seen from FIG. 4B, the leakage rate decreased with increase of the ratio B/C. When the ratio B/C increased to 1.0, the leakage rate decreased to close to 1 cc/min, a value that is specified as permissible from the viewpoint of gas tightness in JIS. Further, when the ratio B/C increased to 1.1, the leakage rate dropped to 1% of the permissible value.

Accordingly, it can be seen from FIG. 4B that specifying the ratio B/C to be no less than 1.1, high gas tightness of the spark plug 100 can be secured.

Consequently, to allow the crimped portion 14 to exert a sufficiently large constricting force on the sealing members 61-63 and to secure high gas tightness of the spark plug 100, in this embodiment, the following dimensional relationship has been specified:

$$B \geqq 1.1\ C.$$

Thirdly, the effective range of the thickness C of the buckled portion 15 of the metal shell 10 has been determined in light of the following consideration.

As described previously, when the intermediate portion 15 of the uncrimped metal shell 10 has a large wall thickness, the rigidity of the intermediate portion 15 is accordingly high. As a result, it becomes difficult to deform the intermediate portion 15 to form the buckled portion 15 of the metal shell 10 that has a correspondingly large thickness C.

Accordingly, the thickness C of the buckled portion 15 has an upper limit, which has been determined as 1.0 mm in this embodiment.

On the contrary, when the intermediate portion 15 of the uncrimped metal shell 10 has a small wall thickness, the rigidity of the intermediate portion 15 is accordingly low. As a result, the intermediate portion 15 will be deformed too easily, so that the resultant buckled portion 15 of the metal shell 10 has an aberrant form and low rigidity.

Accordingly, the thickness C of the buckled portion 15 has a lower limit, which has been determined as 0.5 mm in this embodiment.

Consequently, to allow the buckled portion 15 of the metal shell 10 to be easily formed and have sufficiently high rigidity, in this embodiment, the thickness C of the buckled portion 15 of the metal shell 10 has been specified to be in the range of 0.5 to 1.0 mm.

Fourthly, the effective range of the length D of the crimped portion 14 of the metal shell 10 has been determined through experimentation.

When the length D of the crimped portion 14 was greater than 4.0 mm, the end of the crimped portion 14 collided with the insulator 20, thus causing damage to the insulator 20.

On the contrary, when the length D of the crimped portion 14 was less than 0.7 mm, the crimped portion 14 could not securely constrict the second ring 62 in the gap 60, thus making it impossible to form a hermetic seal between the metal shell 10 and the insulator 20.

Consequently, in this embodiment, the length D of the crimped portion 14 of the metal shell 10 has been specified to be in the range of 0.7 to 4.0 mm.

To more reliably prevent causing damage to the insulator 20 and secure formation of the hermetic seal, it is preferable that the length D of the crimped portion 14 is in the range of 1.5 to 3.5 mm.

Fifthly, the effective range of the length E of the buckled portion 15 of the metal shell 10 has been determined through experimentation.

When the length E of the buckled portion 15 was greater than 4.0 mm, the buckled portion 15 was formed to have a wavy shape and thus collided with the insulator 20.

On the contrary, when the length E of the buckled portion 15 was less than 1.5 mm, it was difficult to form the buckled portion 15 of the metal shell 10 through deforming the intermediate 15 of the uncrimped metal shell 10.

Consequently, in this embodiment, the length E of the buckled portion 15 of the metal shell 10 has been specified to be in the range of 1.5 to 4.0 mm.

Sixthly, the effective ranges of the length L and width T of the gap 60 have been determined through experimentation.

It has been considered that the quantity of the powered talc 63 embedded in the gap 60 increases with the length L and width T of the gap 60 (in other words, with the volume of the gap 60), and the gas tightness of the spark plug 100 increases with that quantity.

Sample spark plugs 100 having different L or/and T, in which the outer diameter of the insulator 20 is 9 mm, the thickness B of the crimped portion 14 of the metal shell 10 is 0.95 mm, the thickness C of the buckled portion 15 of the metal shell 10 is 0.55 mm, the length D of the crimped portion 14 is 2.3 mm, and the length E of the buckled portion 15 is 3.0 mm, were fabricated for the experimentation.

Two tests were conducted using those sample spark plugs 100 in the same manner as the above-described leakage rate test.

In the first test, the length L of the gap 60 was varied, while the width T of the gap 60 was kept constant at 1.4 mm.

Figure 5:
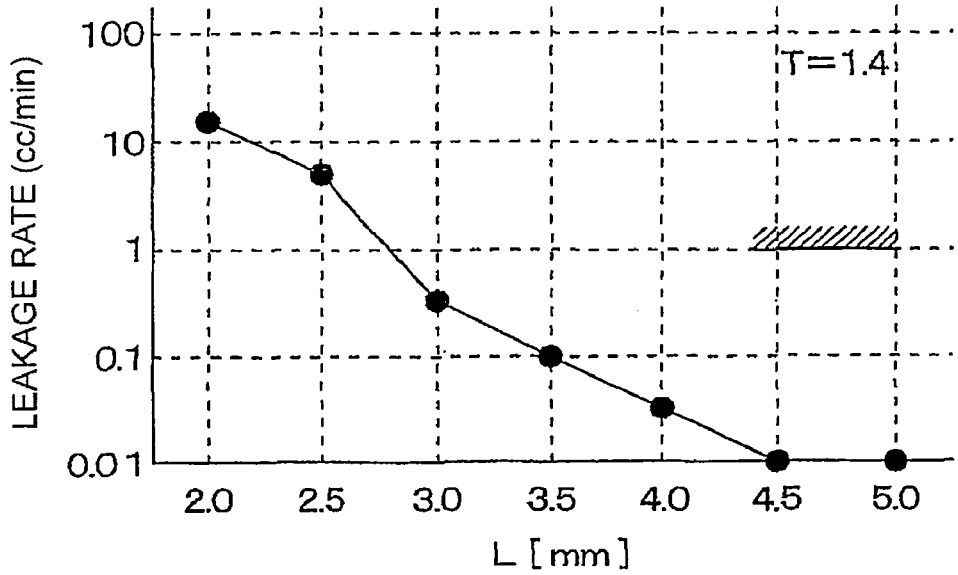
FIG. 5 is a graphical representation showing the relationship between a dimensional parameter L and the leakage rate from the inside of the spark plug of FIG. 1.

FIG. 5 shows the results of the first test, where the horizontal axis indicates the length L of the gap 60, while the vertical one indicates the resultant leakage rate.

As seen from FIG. 5, the leakage rate decreased with increase of the length L of the gap 60. When the length L of the gap 60 increased to 3.0 mm, the leakage rate decreased to below the permissible value of 1 cc/min.

Consequently, in this embodiment, the length L of the gap 60 has been specified to be greater than or equal to 3.0 mm.

On the other hand, in the second test, the width T of the gap 60 was varied, while the length L of the gap 60 was kept constant at 4.5 mm.

Figure 6:
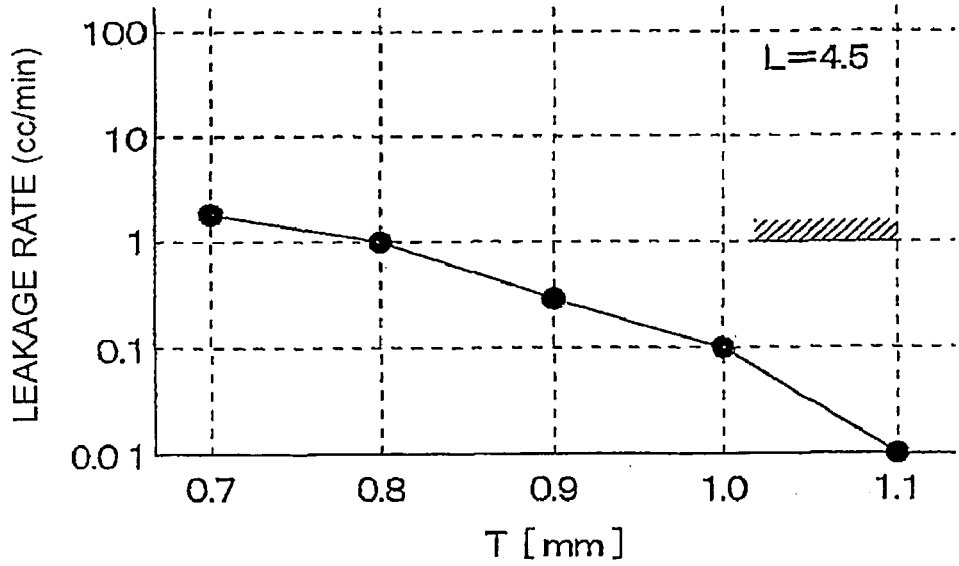
FIG. 6 is a graphical representation showing the relationship between a dimensional parameter T and the leakage rate from the inside of the spark plug of FIG. 1.

FIG. 6 shows the results of the second test, where the horizontal axis indicates the width T of the gap 60, while the vertical one indicates the resultant leakage rate.

As seen from FIG. 6, the leakage rate decreased with increase of the width T of the gap 60. When the width T of the gap 60 increased to 0.8 mm, the leakage rate decreased to the permissible value of 1 cc/min. Further, when the width T of the gap 60 increased to 1.0 mm, the leakage rate decreased to 10% of the permissible value.

Consequently, in this embodiment, the width T of the gap 60 has been specified to be greater than or equal to 1.0 mm.

Accordingly, specifying the length L and width T of the gap 60 as above, the leakage from the inside of the metal shell 10 through the crimped portion 14 of the same can be suppressed, thereby securing high gas tightness of the spark plug 100.

To sum up, the spark plug 100 according to the present embodiment has a compact structure in which the threaded portion 11 of the metal shell 10 has a size of M12 and the width between any two opposite side surfaces of the polygonal prism-shaped portion 12 of the metal shell 10 is no greater than 14 mm.

The structure of the spark plug 100 is characterized in that the thickness A of the polygonal prism-shaped portion 12 of the metal shell 10, the thickness B of the crimped portion 14 of the metal shell 10, and the thickness C of the buckled portion 15 of the metal shell 10 satisfy the following dimensional relationship:

$$A>B>C$$

Through specifying the above dimensional relationship, sufficiently high rigidity of the crimped portion 14 is secured, and during formation of the crimped portion 14, the buckled portion 15 is easily formed while the polygonal prism-shaped portion 12 is prevented from deformation.

As a result, the sealing members 61-63 in the gap 60 are subject to a large constricting force exerted by the crimped portion 14, so that high gas tightness of the spark plug 100 is secured.

Further, in the spark plug 100, the thickness B of the crimped portion 14 and the thickness C of the buckled portion 15 satisfy the following dimensional relationship:

$$B \geqq 1.1\ C.$$

Through specifying the above dimensional relationship, the sealing members 61-63 in the gap 60 are further reliably subject to a large constricting force exerted by the crimped portion 14, so that high gas tightness of the spark plug 100 is further reliably secured.

Moreover, in the spark plug 100, the thickness C of the buckled portion 15 is specified to be in the range of 0.5 to 1.0 mm.

Through specifying the above range, the buckled portion 15 is easily formed during formation of the crimped portion 14 and has sufficiently high rigidity.

Further, in the spark plug 100, the length D of the crimped portion 14 is specified to be in the range of 0.7 to 4.0 mm.

Through specifying the above range, the crimped portion 14 is prevented from colliding with the insulator 20 and securely constricts the second ring 62 in the gap 60.

It is preferable that the length D of the crimped portion 14 is in the range of 1.5 to 3.5 mm.

Moreover, in the spark plug 100, the length E of the buckled portion 15 is specified to be in the range of 1.5 to 4.0 mm.

Through specifying the above range, the buckled portion 15 is easily formed during formation of the crimped portion 14 and prevented from having an aberrant form and colliding with the insulator 20.

Furthermore, in the spark plug 100, the length L of the gap 60 is specified to be greater than or equal to 3.0 mm and the width T of the same is specified to be greater than or equal to 1.0 mm.

Through specifying the above ranges, a large quantity of the powered talc 63 is embedded in the gap 60, so that the leakage from the inside of the metal shell 10 through the crimped portion 14 of the same is suppressed, thus securing high gas tightness of the spark plug 100.

Second Embodiment

Figure 7:
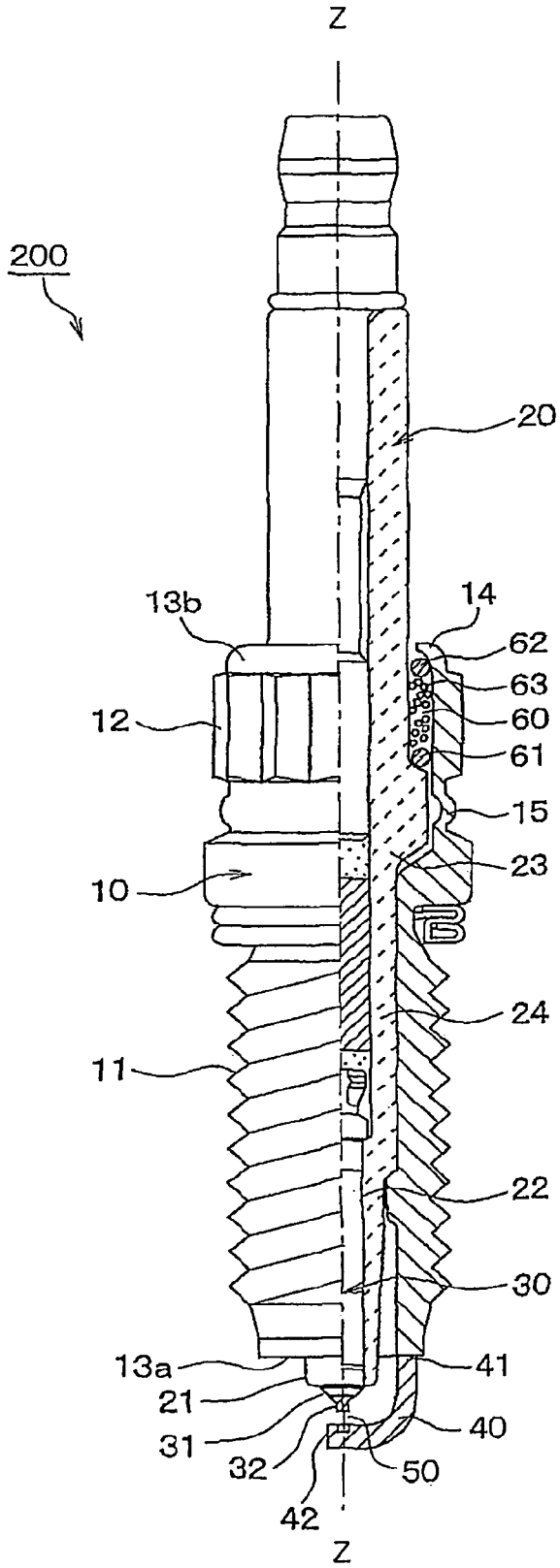
FIG. 7 is a partially cross-sectional side view showing the overall structure of a spark plug according to the second embodiment of the invention.

FIG. 7 shows the overall structure of a spark plug 200 according to the second embodiment of the invention, which is designed for use in internal combustion engines of automotive vehicles.

The spark plug 200 has a structure almost identical to that of the spark plug 100 according to the previous embodiment. Accordingly, only main differences between the spark plugs 100 and 200 are to be described below.

As described previously, the spark plug 100 includes the metal shell 10 in which the threaded portion 11 has a size of M12, the polygonal prism-shaped portion 12 has a shape of hexagon in any cross section perpendicular to the axis Z of the metal shell 10, and the width between any two opposite side surfaces of the polygonal prism-shaped portion 12 is no greater than 14 mm.

Figure 8:
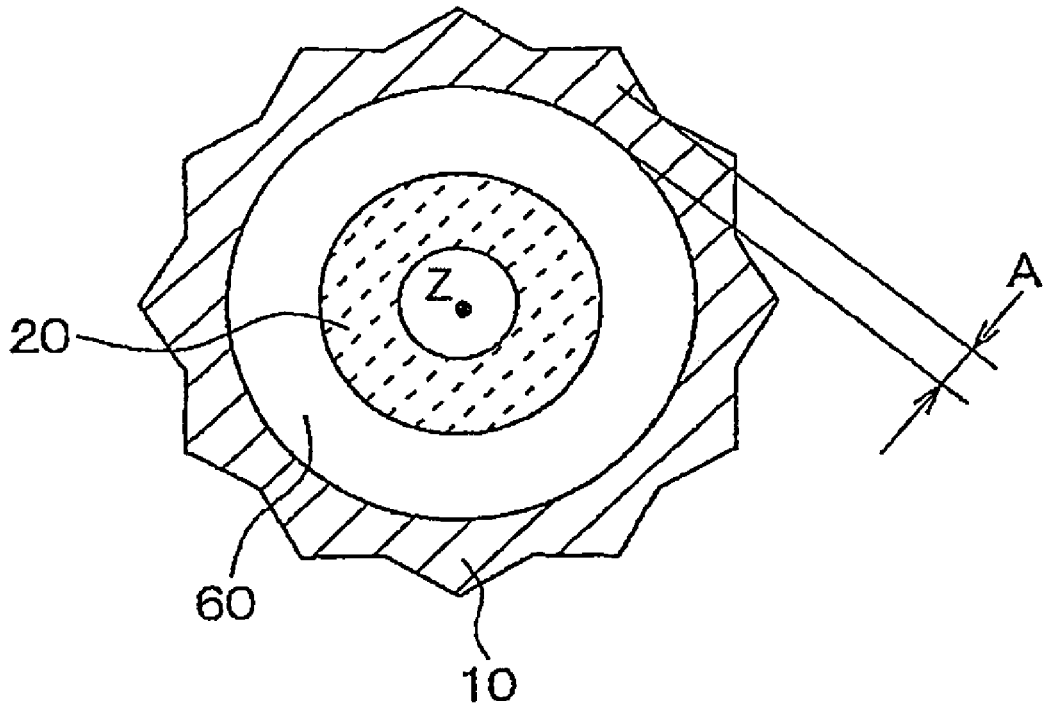
FIG. 8 is a cross sectional view of a polygonal prism-shaped portion of a metal shell in the spark plug of FIG. 7, which is taken perpendicular to the axis of the metal shell through the middle position of the polygonal prism-shaped portion in the axial direction of the metal shell.

In comparison, the spark plug 200 includes a metal shell 10 in which a threaded portion 11 has a size of M10 as specified in JIS, a polygonal prism-shaped portion 12 has a shape of Bi-HEX 12 as shown in FIG. 8 in any cross section perpendicular to an axis Z of the metal shell 10, and the width between any two opposite side surfaces of the polygonal prism-shaped portion 12 is no greater than 12 mm.

In such a spark plug 200, dimensional parameters A, B, C, D, E, T, and L have the same definitions as in the spark plug 100.

Further, in the spark plug 200, the above parameters have been specified, through experimental investigation, to have the same effective ranges and relationships therebetween as in the spark plug 100.

For example, the effective range of the ratio B/C in the spark plug 200 has been specified through two tests as described in the previous embodiment.

Specifically, sample spark plugs 200 having different B or/and C, in which the outer diameter of the insulator 20 is 7.5 mm, the width T of the gap 60 is 1.4 mm, the length L of the gap 60 is 4.5 mm, the length D of the crimped portion 14 of the metal shell 10 is 2.2 mm, and the length E of the buckled portion 15 of the meal shell 10 is 3.0 mm, were fabricated for the tests.

The first test was conducted to measure the constricting force that the crimped portion 14 of the metal shell 10 exerts on the sealing members 61-63 in the axial direction of the metal shell 10.

Figure 9A:
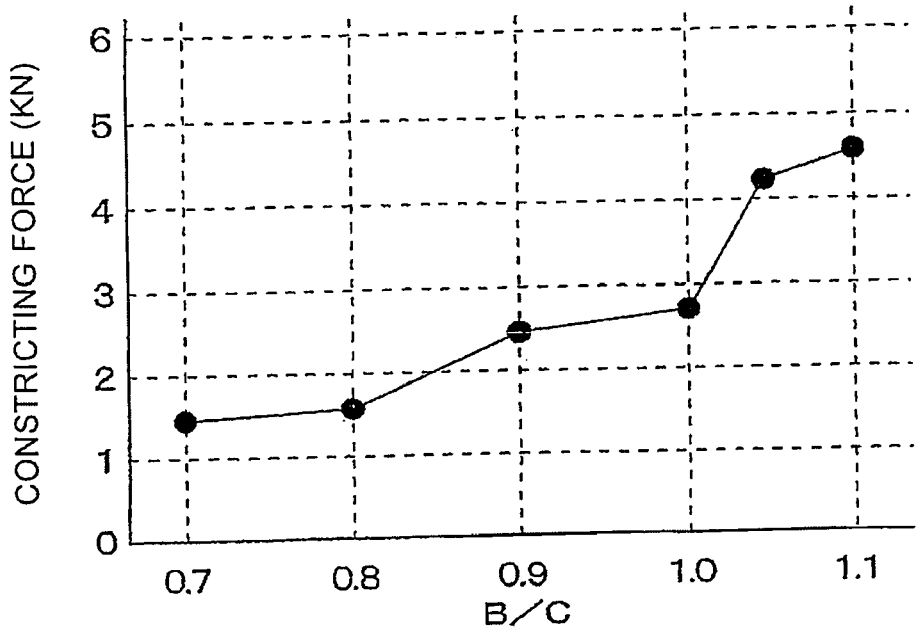
FIG. 9A is a graphical representation showing the relationship between the dimensional parameter B/C and a constricting force in the spark plug of FIG. 7.

FIG. 9A shows the results of the first test, where the horizontal axis indicates the ratio B/C between the thickness B of the crimped portion 14 and the thickness C of the buckled portion 15, while the vertical one indicates the resultant constricting force.

It can be seen from FIG. 4A that specifying the ratio B/C to be no less than 1.1, the crimped portion 14 of the metal shell 10 can exert a sufficiently large constricting force on the sealing members 61-63.

The second test was conducted to measure the leakage rate from the inside of the metal shell 10 through the crimped portion 14 of the same.

Figure 9B:
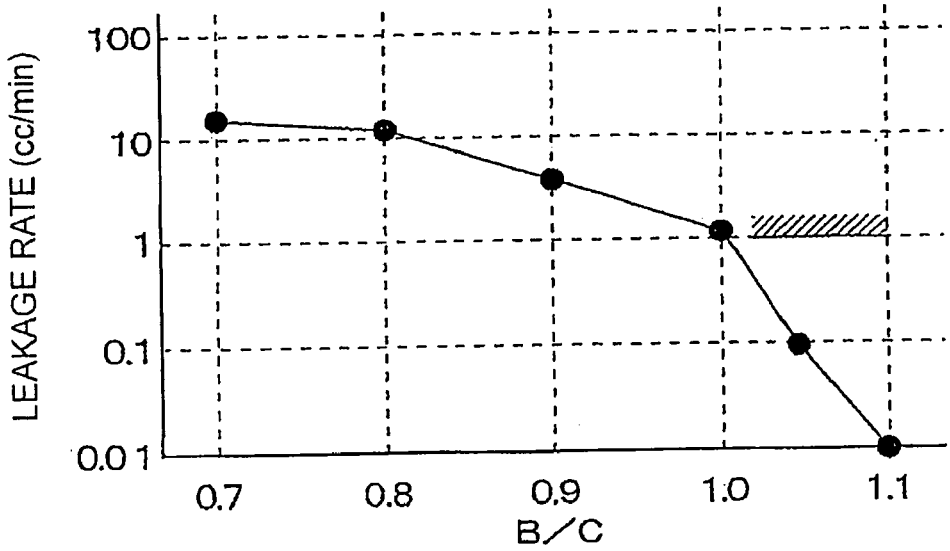
FIG. 9B is a graphical representation showing the relationship between the dimensional parameter B/C and a leakage rate from the inside of the spark plug of FIG. 7.

FIG. 9B shows the results of the second test, where the horizontal axis indicates the ratio B/C between the thickness B of the crimped portion 14 and the thickness C of the buckled portion 15, while the vertical one indicates the resultant leakage rate.

It can be seen from FIG. 4B that specifying the ratio B/C to be no less than 1.1, the leakage from the inside of the metal shell 10 through the crimped portion 14 of the same can be suppressed, thereby securing high gas tightness of the spark plug 200.

Consequently, in the spark plug 200, the thickness B of the crimped portion 14 and the thickness C of the buckled portion 15 have been specified to satisfy the following dimensional relationship:

$$B \geqq 1.1\ C.$$

Accordingly, the spark plug 200 according to the present embodiment also has a compact structure, in which dimensional parameters have the same effective ranges and relationships therebetween as in the spark plug 100, and high gas tightness.

Other Embodiments

While the above particular embodiments of the invention have been shown and described, it will be understood by those who practice the invention and those skilled in the art that various modifications, changes, and improvements may be made to the invention without departing from the spirit of the disclosed concept.

For example, in the spark plug 100 according. to the first embodiment, the polygonal prism-shaped portion 12 has a shape of hexagon (HEX) in any cross section perpendicular to the axis Z of the metal shell 10.

However, it may have a shape of Bi-HEX in any cross section perpendicular to the axis Z of the metal shell 10.

Similarly, in the spark plug 200 according to the second embodiment, the polygonal prism-shaped portion 12 has a shape of Bi-HEX in any cross section perpendicular to the axis Z of the metal shell 10.

However, it may have a shape of hexagon (HEX) in any cross section perpendicular to the axis Z of the metal shell 10.

Such modifications, changes, and improvements within the skill of the art are intended to be covered by the appended claims.

What is claimed is:

1. A spark plug comprising:

a tubular metal shell having an axis and a first end and a second end that are opposite to each other in an axial direction of said metal shell, said metal shell including a threaded portion, a polygonal prism-shaped portion, and a buckled portion, the threaded portion being formed on an outer periphery of said metal shell close to the first end of said metal shell and having a size of one of M10 and M12, the polygonal prism-shaped portion being formed close to the second end of said metal shell and having a width, which is a distance between any two opposite side surfaces of the polygonal prism-shaped portion, of no greater than 14 mm, the buckled portion being positioned between the threaded portion and the polygonal prism-shaped portion in the axial direction of said metal shell, said metal shell also including a crimped portion formed at the second end of said metal shell and a frustoconical shoulder that is provided between the polygonal prism-shaped portion and the crimped portion and tapers toward the crimped portion;

a hollow insulator fixed in said metal shell, said insulator having an end that protrudes from the first end of said metal shell;

a center electrode secured in said insulator, said center electrode having an end that protrudes from the end of said insulator;

a ground electrode having a based end joined to the first end of said metal shell and a tip portion that faces the end of said center electrode in the axial direction of said metal shell through a spark gap; and sealing members provided in a gap between an inner surface of the polygonal prism-shaped portion of said metal shell and an outer surface of said insulator, said sealing members being subject to a constricting force exerted by the crimped portion of said metal shell to form a hermetic seal between said metal shell and said insulator, wherein the following dimensional relationship is specified:

$$A>B>C, \text{ where}$$

A is a minimum radial thickness of the polygonal prism-shaped portion of said metal shell on a first reference plane that is defined to extent perpendicular to the axis of said metal shell through a middle position of the polygonal prism-shaped portion in the axial direction of said metal shell, B is a distance between an inner surface of the crimped portion of said metal shell and a reference point in a radial direction of said metal shell, the reference point being defined, on a second reference plane that is defined to extend to include the axis of said metal shell thereon, as an intersection between a first reference line and a second reference line, the first reference line being defined to extend tangent to an outer surface of the crimped portion of said metal shell through a first end of an arc that continues to the outer surface of the crimped portion at the first end and to an outer surface of the frustoconical shoulder of said metal shell at a second end thereof, the second reference line being defined to extend, through the second end of the arc, to have a section thereof on the outer surface of the frustoconical shoulder, and C is a radial thickness of the buckled portion of said metal shell on a third reference plane that is defined to extent perpendicular to the axis of said metal shell through a middle position of the buckled portion in the axial direction of said metal shell.

2. The spark plug as set forth in claim 1, wherein the following dimensional relationship is further specified:

$$B \geqq 1.1\ C.$$

3. The spark plug as set forth in claim 1, wherein C is in a range of 0.5 to 1.0 mm.

4. The spark plug as set forth in claim 1, wherein said metal shell is formed by crimping an uncrimped metal shell that includes:

a second end portion that is formed at a second end of said uncrimped metal shell and to be crimped to form the crimped portion of said metal shell;

a polygonal prism-shaped portion that is to form the polygonal prism-shaped portion of said metal shell; and a first frustoconical shoulder that is provided between the second end portion and the polygonal prism-shaped portion of said uncrimped metal shell and tapers toward the second end portion, and wherein a length D of the second end portion of said uncrimped metal shell is in a range of 0.7 to 4.0 mm, which is a distance between the second end of said uncrimped metal shell and a first reference point in an axial direction of said uncrimped metal shell, the first reference point being defined, on a reference plane that is defined to extend to include an axis of said uncrimped metal shell thereon, as an intersection between a first reference line and a second reference line, the first reference line being defined to extend tangent to an outer surface of the second end portion of said uncrimped metal shell through a first end of an arc that continues to the outer surface of the second end portion at the first end and to an outer surface of the first frustoconical shoulder of said uncrimped metal shell at a second end thereof, the second reference line being defined to extend, through the second end of the arc, to have a section thereof on the outer surface of the first frustoconical shoulder of said uncrimped metal shell.

5. The spark plug as set forth in claim 4, wherein the length D of the second end portion of said uncrimped metal shell is in a range of 1.5 to 3.5 mm.

6. The spark plug as set forth in claim 4, wherein said uncrimped metal shell further includes:

a threaded portion that is to form the threaded portion of said metal shell;

an intermediate portion that is positioned between the polygonal prism-shaped portion and the threaded portion of said uncrimped metal shell and to be buckled to form the buckled portion of said metal shell when the second end portion is crimped to form the crimped portion of said metal shell;

a second frustoconical shoulder that is provided between the polygonal prism-shaped portion and the intermediate portion and tapers toward the intermediate portion; and a third frustoconical shoulder that is provided between the intermediate portion and the threaded portion and tapers toward the intermediate portion, and wherein a length E of the intermediate portion of said uncrimped metal shell is in a range of 1.5 to 4.0 mm, which is a distance between a second reference point and a third reference point, the second reference point being defined, in the reference plane, as an intersection between a third reference line and a fourth reference line, the third reference line being defined to extend to have a section thereof on an outer surface of the second frustoconical shoulder, the fourth reference line being defined to extend to have a section thereof on an outer surface of the intermediate portion, the third reference point being defined, in the reference plane, as an intersection between the fourth reference line and a fifth reference line, the fifth reference line being defined to extend to have a section thereof on an outer surface of the third frustoconical shoulder.

7. The spark plug as set forth in claim 1, wherein a width T of the gap is no less than 1.0 mm, which is a distance between the inner surface of the polygonal prism-shaped portion of said metal shell and the outer surface of said insulator in the radial direction of said metal shell on the first reference plane.

8. The spark plug as set forth in claim 1, wherein said sealing members include two metal rings and a filler, which are arranged in the gap between the inner surface of the polygonal prism-shaped portion of said metal shell and the outer surface of said insulator such that the filler is interposed between the two metal rings in the axial direction of said metal shell, and wherein a length L of the gap is no less than 3.0 mm, which is a minimum distance between outer surfaces of the two metal rings in the axial direction of said metal shell.

* * * * *

UNITED STATES PATENT AND TRADEMARK OFFICE

CERTIFICATE OF CORRECTION

PATENT NO. : 7,400,081 B2
APPLICATION NO. : 11/188772
DATED : July 15, 2008
INVENTOR(S) : Ishiguro It is certified that error appears in the above-identified patent and that said Letters Patent is hereby corrected as shown below:

On the Title Page of the Patent, Item

(76) Inventors: Hiroyuki Ishiguro, Kariya-shi (JP)

should be

(76) Inventors: Hiroya Ishiguro, Kariya-shi (JP)

Signed and Sealed this

Twenty-third Day of September, 2008

JON W. DUDAS
*Director of the United States Patent and Trademark Office*